United States Patent [19]

Cobbs

[11] 3,958,637

[45] May 25, 1976

[54] TECHNIQUE FOR LINING SHAFT

[75] Inventor: James H. Cobbs, Tulsa, Okla.

[73] Assignee: The United States of America as represented by the Secretary of the Interior, Washington, D.C.

[22] Filed: May 22, 1975

[21] Appl. No.: 580,111

[52] U.S. Cl. ..... 166/287; 166/253; 166/289; 61/53.66; 61/56.5

[51] Int. Cl.[2] ..... E21B 33/13

[58] Field of Search ..... 166/285, 287, 289, 257; 61/39, 41, 45, 53.64, 53.66, 56.5; 25/124

[56] References Cited

UNITED STATES PATENTS

| | | | |
|---|---|---|---|
| 1,916,686 | 7/1933 | Sandstone | 166/287 |
| 2,080,406 | 5/1937 | Allen | 166/287 |
| 3,001,585 | 9/1961 | Shiplet | 166/289 X |
| 3,131,767 | 5/1964 | Chancellor et al. | 166/289 X |
| 3,194,312 | 7/1965 | Thomas | 166/285 |
| 3,202,213 | 8/1965 | Howard | 166/242 X |
| 3,239,005 | 3/1966 | Bodine, Jr. | 166/287 X |
| 3,293,865 | 12/1966 | Loofbourow et al. | 166/287 X |
| 3,335,795 | 8/1967 | Richards et al. | 166/289 |

*Primary Examiner*—Stephen J. Novosad
*Attorney, Agent, or Firm*—Roland H. Shubert; Donald R. Fraser

[57] ABSTRACT

Method and apparatus for lining large diameter, deep, boreholes in the earth, which provides a relatively thick lining of cement. A slip form is provided having a cylindrical outer wall of the diameter corresponding to the desired inner diameter of the liner. This is supported on a long central pipe through which cement can be pumped through side pipes and through openings in the wall of the slip form. A base unit is provided with an internal diameter substantially equal to that of the slip form. A petal basket of flexible material is not provided to seal against the wall of the borehole. The slip form is attached to the base by means of shear pins, and the assembly lowered into the borehole until the base is on bottom. Cement is pumped down through the central pipe and out through the openings in the slip form to form a cement liner between the slip form, the base, and the wall of the borehole. When the cement reaches a first set, the slip form is lifted, breaking the shear pins. Cement is then pumped through the upper set of openings and the slip form is raised at a slow controlled rate, so that there is always support for the cement at the lowest part of the slip form, so that it has a residence time at least sufficient to reach that first set, before the slip form moves up. This process is continued until the complete liner is in place.

5 Claims, 5 Drawing Figures

TECHNIQUE FOR LINING SHAFT

BACKGROUND OF THE INVENTION

Many boreholes, or mine shafts, and such, are drilled into the earth, of diameters in the range of 6 to 20 feet or more, and to depths of possibly several hundreds to 1,000 feet. In drilling these boreholes, a drilling fluid, or mud, is provided which, by its density, supports the wall of the borehole and prevents crumbling of the earth and rock, particularly where it is unconsolidated. In order to preserve the walls of the shaft to avoid crumbling when the drilling fluid is removed, a liner must be provided, which in the past has been customarily a steel liner, with a cement seal between the liner and the wall of the borehole. This procedure is costly, particularly for large diameter boreholes, and the method of this invention, utilizing a simple cement liner is offered as a preferred substitute.

SUMMARY OF THE INVENTION

There is a particular advantage in lining drilled shafts where mud is used for the hole cleaning and wall support, in that the walls of the shaft remain supported by the hydrostatic pressure of the contained mud, as drilling progresses. This technique offers the possibility for a cast concrete lining to be installed, prior to the removal of the drilling mud from the shaft. Thus, a measure of the shaft support remains at all times during the lining of the shaft.

This procedure also offers a tecnique for the control of aquifers which will not require pregrouting, and the shaft lining will be a continuous lining without interruptions for water rings. Two solutions have been devised for the control of aquifers which will lend themselves to slip form lining. These solutions follow the solutions of the concept of a slip form.

While slip form casting of cement and concrete have been used to some extent in constructions on the surface of the earth, where there is an interior and an exterior form and steel reinforcement, the method of remote, continuous slip form casting has not been used in deep borehole shafts, and requires special attention, particularly for the blind operation of cementing at a remote location, as well as means for control of aquifers and water influx into the borehole.

It is a primary object of this invention to provide a method and apparatus for slip form casting of a cement liner in a large diameter borehole drilled with drilling fluids.

It is a further object of this invention to provide means, in the construction of a cement liner in a large diameter borehole, to make provision for the presence of aquifers in the geologic column through which the shaft is drilled.

These and other objects are realized and limitations of the prior art are overcome in this invention, by use of a slip form which comprises a cylindrical wall, of a diameter corresponding to the desired inner diameter of the liner. This slip form is of substantial length such as 20 feet, or longer, and is supported by means of a vertical axial pipe, through which cement can be pumped from the surface of the shaft down through the supporting pipe, and through a plurality of horizontal radial pipes, which connect to the main pipe, and connect to openings in the wall of the slip form. There are two sets of openings, one near the bottom of the slip form, and another set near the top. Sensor means are provided for detecting the level of cement outside of the slip form to insure that it will not spill over the top edge of the slip form. Such sensors can operate on the basis of pressure measurement, or density, for example.

A base unit is provided, which rests on the bottom of the borehole and has an internal diameter such that the slip form can pass within the base. The base has a flexible petal basket, for example, which rests on the base, and presses against the wall of the borehole. Thus, when the slip form is in the base, and cement is poured from the openings above the base, the cement will be sealed at the bottom of the annular space by means of the petal basket.

The surface of the slip form is positioned inside of the base, and is locked by means of one or more shear pins. The assembly is then lowered into the bore hole and centralized by a centralizer, or other means, until the base rests on the bottom of the borehole. Cement is then pumped down through the support pipe and out through the lower set of openings into the space above the base, between the slip form and the wall of the borehole. This is continued with the cement displacing the mud up the annulus, until the level reaches the level indicator.

The cement is permitted to reach a first set, which generally takes on the order of 30 to 60 minutes. The slip form is then lifted, causing the shear pins to break, permitting the slip form to be lifted, so that the top openings now are clear of the top of the cement previously poured. Additional cement is now pumped down the central pipe and out through the top openings onto the cement column previously poured. The fresh cement must be protected by the flip form for a time corresponding to the minimum set time. Thus, the slip form can be raised at a continual slow rate, with cement being poured into the annulus through the top openings, and the bottom portion of the slip form still protecting the fresh cement until it has a first set. Thereafter, the hydrostatic pressure of the drilling fluid serves to maintain in the wall of cement until it finally reaches a permanent set. If there are no aquifers, the cement liner is carried completely to the surface in the manner described.

It will be clear, that the longer the slip form, the more rapidly it can be raised and the more rapidly cement can be poured. Also, the continuous flow of cement is important since there must be no joints which can leak water from the back of the liner to the front. Continuous pouring is to be preferred. However, pouring with a maximum delay of the first set time will provide good bonding.

If there is an aquifer, it can be sealed off in either of two ways. One method involves putting in a section of steel liner in the form of a pan, the space between the pan and the shaft wall can be left open. Pipes can be provided which extend down to the bottom of the shaft so that water will drain from the aquifer down behind the pan and through the pipes to the bottom of the borehole, and can be disposed of there.

Another method is to place a pan or a plain cylindrical casing or wall, of a vertical extent great enough to extend from below to above the aquifer, and to cement behind this section of casing. Then the slip form casting of the cement liner is continued up the hole.

BRIEF DESCRIPTION OF THE DRAWINGS

These and other advantages of this invention and a better understanding of the principles and details of the invention will be evident from the following description taken in conjunction with the appended drawings in which.

DESCRIPTION OF THE PREFERRED EMBODIMENT

Figure 2:
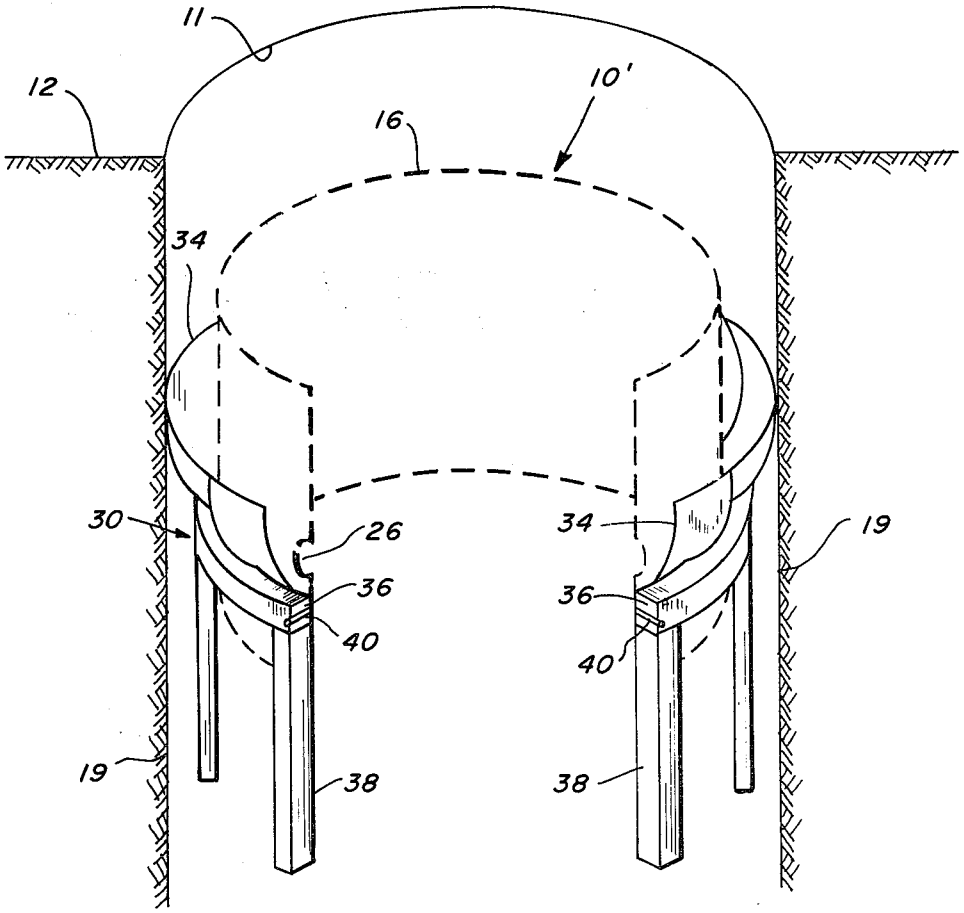
FIG. 2 represents the assembly of the slip form and the base in a borehole in condition for the start of cementing.
Figure 1:
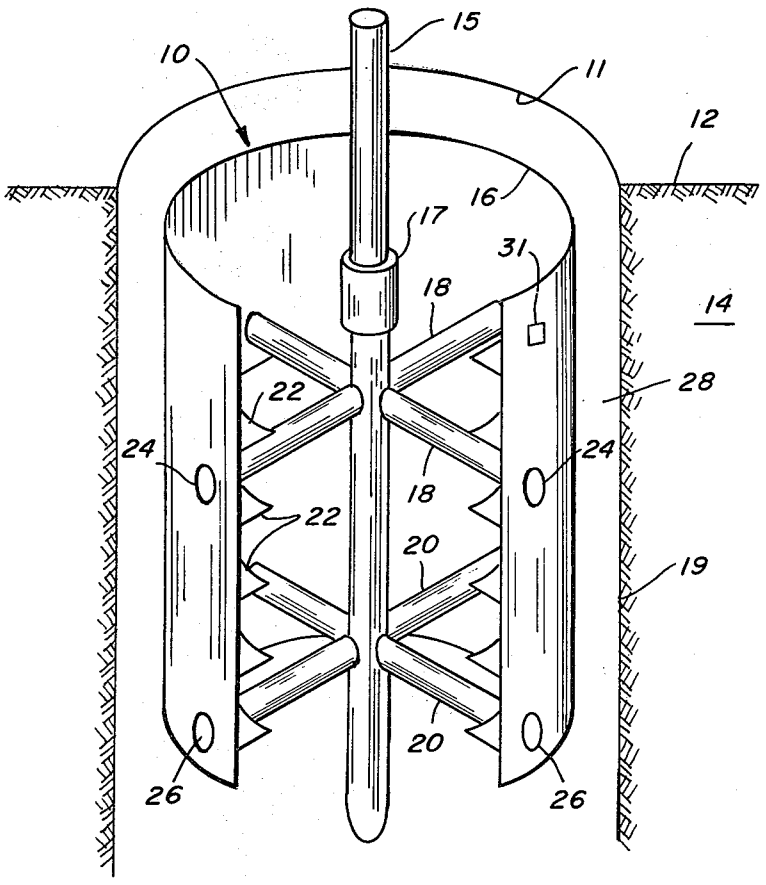
FIG. 1 represents one embodiment of the slip form inserted into a borehole in the earth.

Referring now to the drawings, and in particular to FIGS. 1 and 2, there are shown a slip form apparatus indicated generally by the numeral 10 and a base indicated generally by the numeral 30. A borehole 11 has been drilled into the earth 14 from the surface 12 to a selected depth. The diameter may vary from 6 to 20 feet or more, and the depth may be as great as 1,000 feet. The borehole wall is filled with drilling fluid, or drilling mud as it is conventionally known. A slip form, indicated generally by the numeral 10 is shown placed in the borehole. This comprises a central axial pipe 15 which serves to support and position the slip form. The pipe 15 must be continuous up to the surface. There are two sets of transverse, or radial pipes, 18, 20. Pipes 18 are located near the top of the slip form, and pipes 20 are located near the bottom of the slip form. Each of these pipes 18, 20 connects through an opening through the wall of the slip form. The openings at the bottom are numbered 26 and the openings near the top 24. There may be stiffening means, as desired, indicated schematically by numeral 22. The diameter of the slip form is such that an annular space 28 is provided between the slip form outer wall 16 and the shaft wall 19. This annular space 28 may be of the order of 12 inches or less.

A valve means 17 is provided so that by control at the surface, the cement which will be pumped down the pipe 15 can be diverted through the bottom openings 26 at the start of the cementing program, and then shifted to the upper openings 24 for the rest of the cementing program. Any type of valve control system such as is commonly used in oil well operation can be used. For example, use can be made of the pull that must be made on the pipe 15 to break the shear pins which hold the slip form to the base, as will be described in connection with FIG. 2. This upward pull could close off the openings 26 and open the openings 24, for example.

On the wall 16 of the slip form there is a means indicated by the numeral 31, as a device for detecting the level of cement in the annulus between the slip form and the shaft wall. The need for this is that the pumping of cement must be at a rate that will not overflow the top edge of the wall 16, and therefore the level detector is required. Such detector can be, for example, a pressure gauge which will indicate a change in pressure when the cement wall goes vertically beyond the presence of the sensor 31. Or it can utilize a sensor sensitive to density.

In FIG. 2 there is shown a base unit indicated generally by the numeral 30. This comprises a ring 36 supported on legs 38, or other suitable means. The inner diameter of the ring 36 is such that the wall 16 of the slip form will slide inside of it as shown by the dashed outline 16'. The two are attached together by means of one or more shear pins 40. There are a plurality of flexible petals 34, which are attached to the base 36 in well-known manner and are directed outwardly and curvedly to seal against the wall 19 of the shaft. Thus, when cement is pumped through the openings 26 of FIG. 2, it goes into the space between the wall 16 of the slip form, shown in dashed outline, and the petal basket 34 and the wall 19. The cement is pumped down through the pipe 15 and out through the pipes 20, controlled by valve 17, so that there is no pumpage through the openings 24.

The cement is pumped through the lower openings 26 so that it will wash out and displace upwardly the drilling mud which fills the annulus, and leave a hard, rigid, dense cement cylinder. When the level of cement has reached the sensor 31, the pumping is stopped.

The cement used in the casting of the liner is of such a composition that under the pressure of the mud column and the temperature of the borehole it will reach a first set in a reasonably short time, generally of the order of 30 minutes to 1 hour. This art is very well-known, since in the cementing of deep oil wells, where there are great pressures and high temperatures, compositions have been formulated which will set under predetermined selected temperature, pressure and time conditions.

When a first set is accomplished, of the cement behind the slip form, the flip form is lifted. Because of the weight of cement on the base and the fact that it has sealed to the roughnesses of the wall 19, the base is held down and the shear pins will break, and permit the slip form to move upwardly. It can then move to the point where the lower portion of the wall 16 is in contact with the cement column which has reached a set. Then the valve 17 is operated so as to pump out of the top openings 24, into the space between the slip form and the wall 19. When the level reaches the indicator 31, the rate of pumping will have been such that the residence time of the first cement pumped will be long enough to provide a first set. Therefore the slip form can now be moved slowly up the hole at a rate such that as the cement pours out of the top openings the cement corresponding to the depth of the bottom will be set, and the slip form can keep moving up the hole leaving set cement, supported by the hydrostatic pressure of the drilling mud.

In the absence of aquifers, or other water problems, this process of casting by slowing moving the slip form upward, and pumping at a selected rate will be continued until the slip form reaches the surface.

If, in the drilling of the borehole, and in it subsequent logging, it has been determined that there are aquifers at certain depths, the depths of the bottom and top of the aquifers are recorded. There are two ways of taking care of these aquifers, which unless precautions are taken, will be troublesome. For example, if the cement liner as described previously is continued up past an aquifer, the water will eventually leak through the porosity of the cement liner and will continue to flow into the borehole or shaft through the cement, and down the inner wall of the liner.

Either of two things must be done. One is to direct all water influx into the shaft, through pipes down to the bottom of the borehole, where they can be connected to a pipe and pumped out of the shaft, thus keeping the wall of the liner dry and the shaft dry. The other method is to cement off the aquifers, which requires a different technique. In such cases the cast liner as described previously is terminated below the bottom edge of the aquifer and a steel liner which may be in the form of a pan as shown in FIG. 3 or as a simple steel liner or casing as shown in FIG. 5 is positioned across the aquifer.

Figure 3:
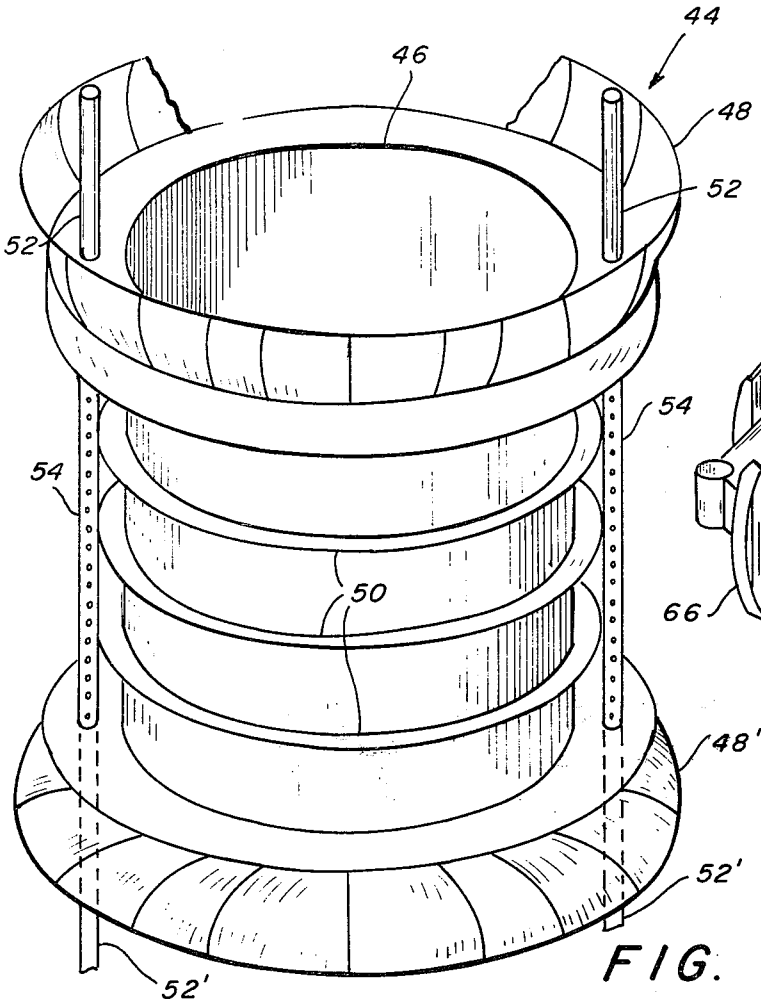
FIG. 3 represents one embodiment of a pan, or liner section, across an aquifer.

Consider the use of the pan as in FIG. 3. This has a cylindrical inner wall 46 of diameter equal to the diameter of the finished liner. This wall can be stiffened by means of circumferential ribs 50, for example. At the top and bottom there are petal baskets 48', similar to that utilized on the base. The lower petal basket 48' sets on top of the cast cement liner. The upward continuation of the cement liner will rest on the upper petal basket 48. These petal baskets must also seal the space behind the pan containing water, from the cement above and below.

A plurality of pipes 52 are placed in the annulus between the cylindrical wall 46 and the wall 19 of the borehole. These pipes are generally perforated 54 in the space behind the pan. The pipes 52 will continue upward to the surface. They are used for lowering the pan into position. The pipes also continue as 52' down to the bottom.

Figure 5:
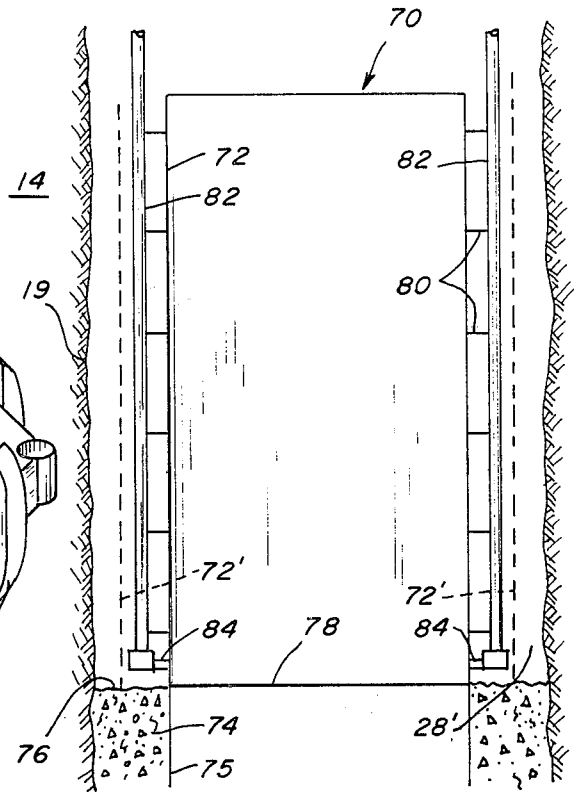
FIG. 5 represents the use of a simple casing section to seal across the aquifer.

In the use of a pan such as shown in FIG. 3 where the pipes 52' are to carry the water from behind the pan down to the bottom of the shaft, the pan must be positioned at the same time that the base is positioned, in order that the pipes 52' will be in position before the cement liner 74 is put in place as shown in FIG. 5.

When the pan is in position, and the cementing is started at the base, the cement liner 74 is carried up until it reaches the bottom petal basket 48'. Then, of course, as the slip form moves up inside of the wall 46 the pumping is stopped until the openings 24 are above the top of the pan and the pumping is continued and the cement liner 74 then is carried up above the level of the top of the pan.

If there are more than one aquifer, the one or more appropriate pans are attached to the pipes 52 and set into position at the start so that they can be cast into the liner, and the pipes 52' carried down to the bottom.

The pipes 52' can then be connected to a suitable line and the water pumped out of the shaft, to the surface. However, it may be decided to squeeze cement the space between the pan and the borehole wall. This is done by pumping cement down through a pipe lowered into the borehole, which is attached at the bottom to the pipes 52'. This cement operation is carried out at relatively high pressure, and can be done only after the cement liner 74 has been throughly cured, and it has its maximum strength. In that case, the pan is locked tightly in the cement liner and cement can be pumped up the pipes 52' through the perforated pipes 54 and out through the perforation to fill the space behind the pan and cement off, or grout, the porosity of the aquifer.

Another way of closing off an aquifer is to set a section of casing, as indicated generally by the numeral 70 in FIG. 5. This is a cylindrical pipe 72 of the diameter of the inner wall of the liner 74. This rests with its bottom edge 78 on the top 76 of the cement. It is supported by a plurality of pipes 82 by means of which the casing 72 is lowered from the surface. Stiffening ribs 80 may be used.

The pipes 82 are made detachable from the casing, by means of left-handed threads, for example, so that they can be unscrewed by turning the pipes to the right. Thus the pipes 82 can be separated from the casing once it is in position. Cement can then be pumped down behind the casing 72 and the aquifer cemented off by that means. The pipes are then lifted out of the hole and the slip form is lowered back in until it is inserted inside of the liner 72 and cement is then pumped through the upper openings and the liner 74 is continued up above the top of the casing 72. If there are additional aquifers, there will be additional portions of casings 72 that will be set again on the top of the cement lining, at the proper level, cemented behind, and so forth.

If desired, the diameter of the casing 72 can be of greater diameter then the interior diameter of the cement liner 74. In other words, the casing 72 might correspond to the dashed line 72'. In that case the pipes 82 will be in this annular space 28' between the casing 72' and the wall 19. This would provide an opportunity for carrying the cemented liner 74 continuously up and past the casing 72, where part of the cement would be behind the casing 72' and part of the cement would be inside of it. The purpose of the metal casing 72 is to overcome the natural porosity of the cement and to seal off water in that way. Setting the casing at an intermediate point between the liner diameter and the wall diameter may provide a better water seal than having it of the same diameter as the cement liner 74 as shown in FIG. 5.

Figure 4:
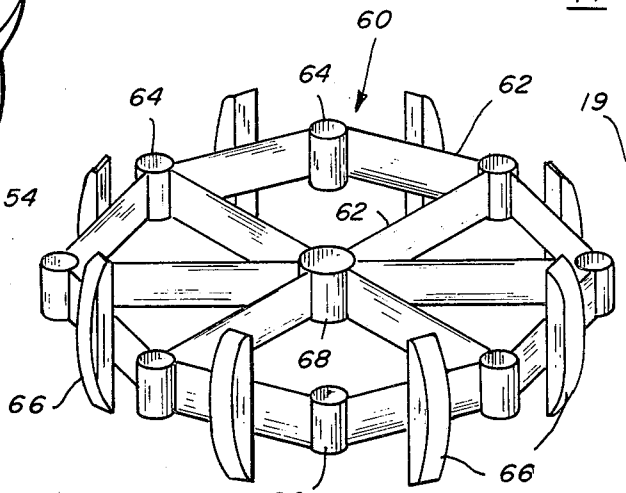
FIG. 4 represents one embodiment of a centralizing device.

Shown in FIG. 4 is one suggested form of centralizer assembly which can be used with the slip form. It would be positioned on the pipe 15 above the slip form, by inserting the pipe 15 through the central ring 68 of the centralizer. The other short sections of pipe, or rings 64, out near the wall, would serve to carry the pipes such as 52 of FIG. 3 or 82 of FIG. 5. Springs such as 66 might be provided on the outer periphery of the centralizer so as to press against the wall 19 of the borehole. Adequate braces such as 62 would be provided. By the use of a centralizer such as shown in FIG. 4, the slip form can be kept properly centered in the borehole so that the annular space 28 will be of uniform thickness and therefore the cement liner will be of uniform thickness throughout the length of the borehole.

What has been described has been an apparatus and method for remotely constructing a cement liner, by use of a continuously moving slip form with special means to prepare the bottom of the liner and support it. Other special means and methods are provided for sealing off, or handling the effluent from aquifers.

While the invention has been described with a certain degree of particularity, it is manifest that many changes may be made in the details of construction and the arrangement of components. It is understood that the invention is not to be limited to the specific embodiment set forth herein by way of exemplying the invention, but the invention is to be limited only by the scope of the attached claim or claims, including the full range of equivalency to which each element or step thereof is entitled.

I claim:

1. The method of remote cement lining of a deep, large diameter, borehole in the earth, filled with drilling fluid, comprising the steps of:

a. providing a base on which said lining is to be supported at a selected distance above the bottom of said borehole, said base having an inner diameter which is the same as that of the finished liner, and means to seal against the wall of said borehole;

b. providing a slip form means, with support conduit means to support said slip form, the outer diameter equal to the internal diameter of said liner, said support conduit connected by pipes through the cylindrical wall of said slip form at one or more openings near the bottom, and at one or more openings near the top of said cylindrical wall;

c. attaching said base to said slip form with shearable fastening means, and lowering said slip form into the borehole until said base rests on the bottom of the borehole;

d. pumping cement down through said support conduit means and through said bottom openings, and into the space above said base;

e. allowing time for said cement to set;

f. lifting said slip form and breaking said shear fastenings; and g. slowly continuously lifting said slip form, while pumping cement through said top openings, the rate of pumping and the rate of lifting being adjusted so that the cement liner is supported at each level, by said slip form, for a time greater than the time for the cement to have a first set.

2. The method as in claim 1 including the steps of:

h. discontinuing the pumping of cement as in step (g) when the level of cement has reached a point below the level of an aquifer;

i. lifting said slip form out of the borehole;

j. lowering by means of a plurality of small pipes a section of casing of a diameter at least equal to the inner diameter of said cement liner, said casing of vertical extent sufficient to reach to a level above said aquifer;

k. lowering said slip form into the borehole and into said casing;

l. pumping cement through said top openings until the space between said casing and the borehole wall is filled with cement; and m. repeating step (g).

3. The method as in claim 2 including, after step (j) and before step (k) of:

n. using said plurality of pipes which had been used to lower said casing, pumping cement down said pipes to a point near the bottom of said casing until the space behind said casing is filled with cement;

o. stopping said pumping and removing said pipes; and p. repeating steps (g).

4. The method as in claim 1 including after step (b) the steps of:

q. providing a pan, comprising a section of casing of selected length, with stiffening means, and means at top and bottom to seal between said pan and the wall of said borehole;

r. attaching a plurality of pipes to said pan in the annulus between said inner wall and the wall of said borehole;

s. attaching said pipes to said base so that when said base is on bottom, said pan will be at a selected depth, corresponding to the position of an aquifer, said pipes perforated in the space behind said pan;

t. running said base, said pipes, said pan, and additional pipes until said base is on bottom and said an is opposite said aquifer;

u. lowering said slip form so that it is in position adjacent said base; and v. continuing with step (d).

5. The method as in claim 4 including:

the step of attaching a conduit means to the bottom ends of said pipes and pumping cement into and up said pipes until the space between said pan and said borehole wall is filled with cement.

* * * * *